US010159629B2

(12) United States Patent
Oneto

(10) Patent No.: US 10,159,629 B2
(45) Date of Patent: Dec. 25, 2018

(54) TEETHER

(71) Applicant: Francesca Oneto, Gaithersburg, MD (US)

(72) Inventor: Francesca Oneto, Gaithersburg, MD (US)

( * ) Notice: Subject to any disclaimer, the term of this patent is extended or adjusted under 35 U.S.C. 154(b) by 153 days.

(21) Appl. No.: 14/218,954

(22) Filed: Mar. 18, 2014

(65) Prior Publication Data

US 2014/0296914 A1 Oct. 2, 2014

Related U.S. Application Data

(60) Provisional application No. 61/800,217, filed on Mar. 15, 2013.

(51) Int. Cl.

| | |
|---|---|
| ***A61J 17/02*** | (2006.01) |
| ***A61J 9/00*** | (2006.01) |
| ***A61J 11/00*** | (2006.01) |
| *A61J 17/00* | (2006.01) |

(52) U.S. Cl.

CPC ..... *A61J 17/02* (2013.01); *A61J 9/006* (2013.01); *A61J 11/007* (2013.01); *A61J 17/008* (2015.05); *A61J 2200/44* (2013.01)

(58) Field of Classification Search

CPC ..... A61J 17/00; A61J 17/02; A61J 2017/001
See application file for complete search history.

(56) References Cited

U.S. PATENT DOCUMENTS

| | | | | |
|---|---|---|---|---|
| 1,731,302 | A * | 10/1929 | Erringer | 606/235 |
| 2,703,087 | A * | 3/1955 | Newmark | A61J 17/02 428/13 |
| 3,022,915 | A * | 2/1962 | Mullin | A61J 11/0065 215/11.1 |
| 5,038,948 | A * | 8/1991 | Signorini | 215/11.1 |
| 5,342,398 | A * | 8/1994 | Sun | 606/235 |
| 5,606,871 | A * | 3/1997 | Hansen et al. | 62/457.5 |
| 5,688,238 | A * | 11/1997 | Moser | A47G 21/18 215/11.6 |
| 2005/0284835 | A1* | 12/2005 | McKendry | A47J 41/0077 215/11.1 |
| 2013/0245687 | A1* | 9/2013 | Bachmann | 606/235 |

* cited by examiner

*Primary Examiner* — Diane Yabut

(57) ABSTRACT

A teether includes a body, and a teething member. When the teether is frozen, the teething member is positioned within the teether providing rigidity to the teether. The teething member is moveable within the body as the frozen material within the body melts. The teether may include a cylindrical body, a nipple, and a cap with the teething member providing rigidity to the nipple. The teether may also be formed from a flexible membrane with at least one acute edge. An insulative storage container for the teether has an internal structure sized to hold multiple teethers.

18 Claims, 9 Drawing Sheets

TEETHER

FIELD OF THE INVENTION

This invention is generally related to the area of teethers. In particular, the invention is related to a teether containing a freezable liquid and a movable shaft.

BACKGROUND OF THE INVENTION

As infants grow and develop teeth, they often like to chew and suck on various objects. Teethers can provide infants with a safe way to satisfy their chewing and sucking urges and to help ensure they do not chew on items that might injure them, for example, by being swallowed.

Baby soothers in general and pacifiers in particular have been in common use for many years. It is well known that teethers ideally provide the most comfortable surface possible against which a baby can chew to relieve the discomfort which attends teething and to accommodate the sucking desire of children.

As a result, teethers are typically made of both soft and hard rubber and any other material which combines resistivity and resiliency to provide a surface best suited to relieve the discomfort of teething and to satisfy the sucking urge of children.

It has also been recognized that coolness (30 degrees to 65 degrees Fahrenheit) is soothing to babies who are teething. Fluid filled teething rings and other shapes which are refrigerated before use have been manufactured and used for years to satisfy the desire for having something cool and soothing for babies to chew on while teething.

Most teething ring structures do not have the classic pacifier shape which babies enjoy. In addition, current teething ring structures are uncomfortable for the baby to hold because they are cold from refrigeration. In addition, manufacturers of current teething rings recommend that you do not put the teething ring in the freezer portion of the refrigerator because the liquid inside the teething ring is water and will freeze, causing the teething ring to be hard and uncomfortable for the baby. Thus, the structure of current teething rings are uncomfortable for children because they don't have the traditional pacifier shape and they are difficult to hold because they are cold.

Additionally, teething ring manufacturers have made no provision for keeping the teething ring cold while away from the home. Thus, teething rings are less effective while travelling away from home because there is no specific means to keep them cool thus reducing their effectiveness.

SUMMARY OF THE INVENTION

It is an objective of this invention to provide a teether which provides an internal cooling liquid to ease the discomfort of teething babies.

It is a further object of this invention to provide a teether which is filled with liquid and frozen.

Another object of the invention is to provide a teether having a shaped body, such as a predominately cylindrical body, that is easy to hold.

Another object of the invention is to provide a teether with a teething stick.

Another object of the invention is to provide a teether with a teething stick that is displaceable along the cylindrical axis of the teether.

Another object of the invention is to provide a teether that encourages fine motor skills and stimulates the senses.

Another object of the invention is to provide a teether with a stand by which the teether may stably sit in the freezer while the internal fluid is freezing.

These and other objects, benefits, features, and advantages of the present invention will become apparent from the drawings and specification that follows.

A BRIEF DESCRIPTION OF DRAWINGS

DESCRIPTION OF THE PREFERRED EMBODIMENT

Figure 1:
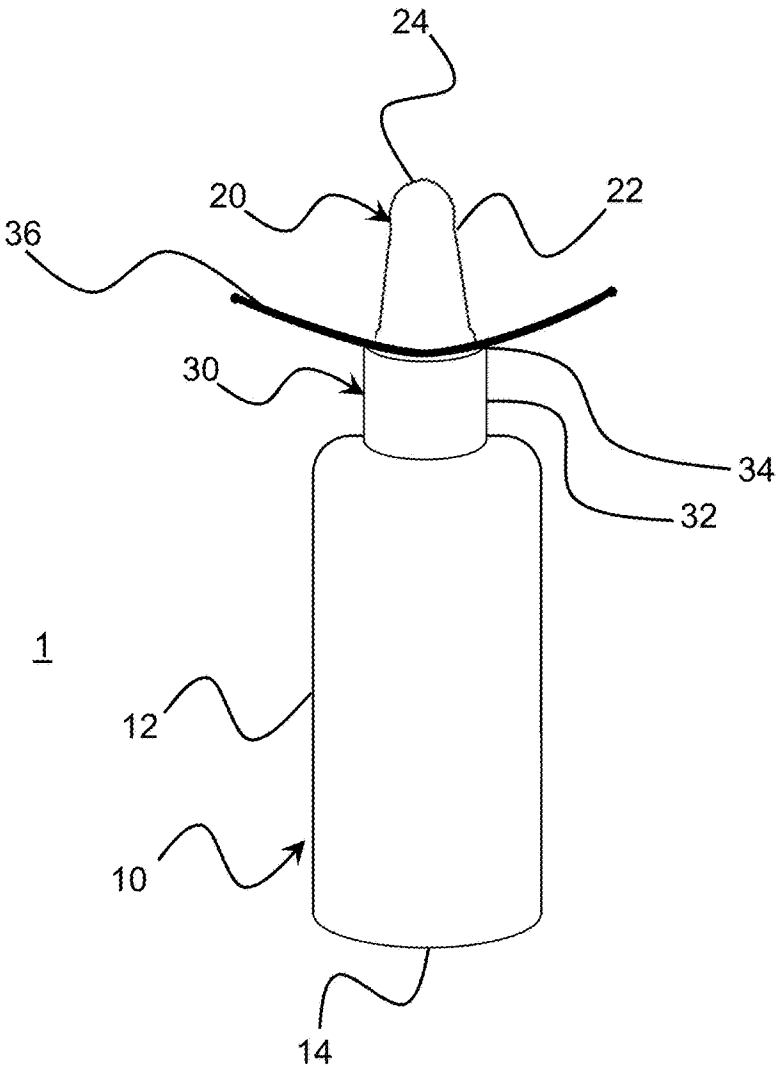
FIG. 1 is an illustrative perspective view of a teether.
Figure 2:
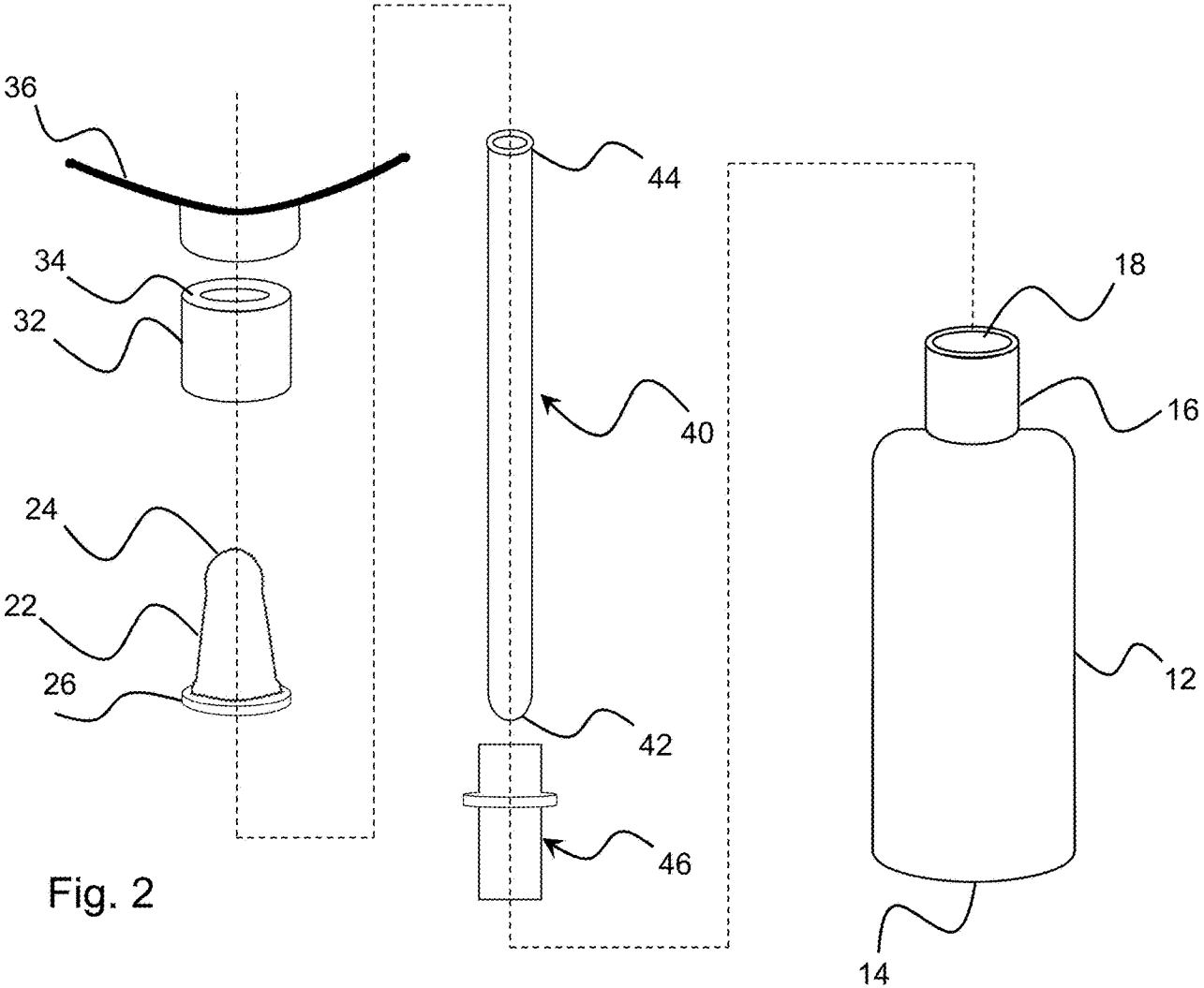
FIG. 2 is an exploded view of the teether.

Referring to the drawings, FIGS. 1 and 2 show a first embodiment of a teether 1. The teether 1 includes a cylindrical body 10, a nipple 20, and a cap 30.

The cylindrical body 10 includes a cylindrical wall 12, a bottom base 14, a neck 16, and an opening 18.

The nipple 20 includes a flexible cylindrical wall 22, a flexible bulbous or rounded end 24 located at a first end of the flexible cylindrical wall 22 and a flexible annular flange 26 located at an opposite end of the flexible cylindrical wall 22. The cylinder wall 22 is sufficiently long enough for the rounded end 24 to reach at least half way along the gum line on each side of the baby's mouth.

The cap 30 includes a cylindrical wall 32 and an annular flange 34. The hollow cylindrical wall 32 may include internal threads. When assembled, the internal threads of cap 30 engage the opening 18 of the cylindrical body 10 having matching external threads about the opening 18. Other suitable means known in the art to fix the cap 30 to the cylindrical body 10 are also envisioned with or without a threaded engagement.

Figure 2A:
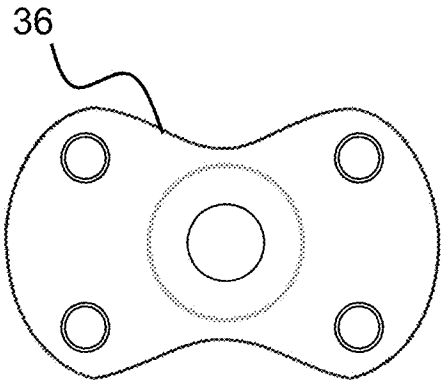
FIG. 2A is a view of the top of the butterfly flange of the teether.
Figure 3:
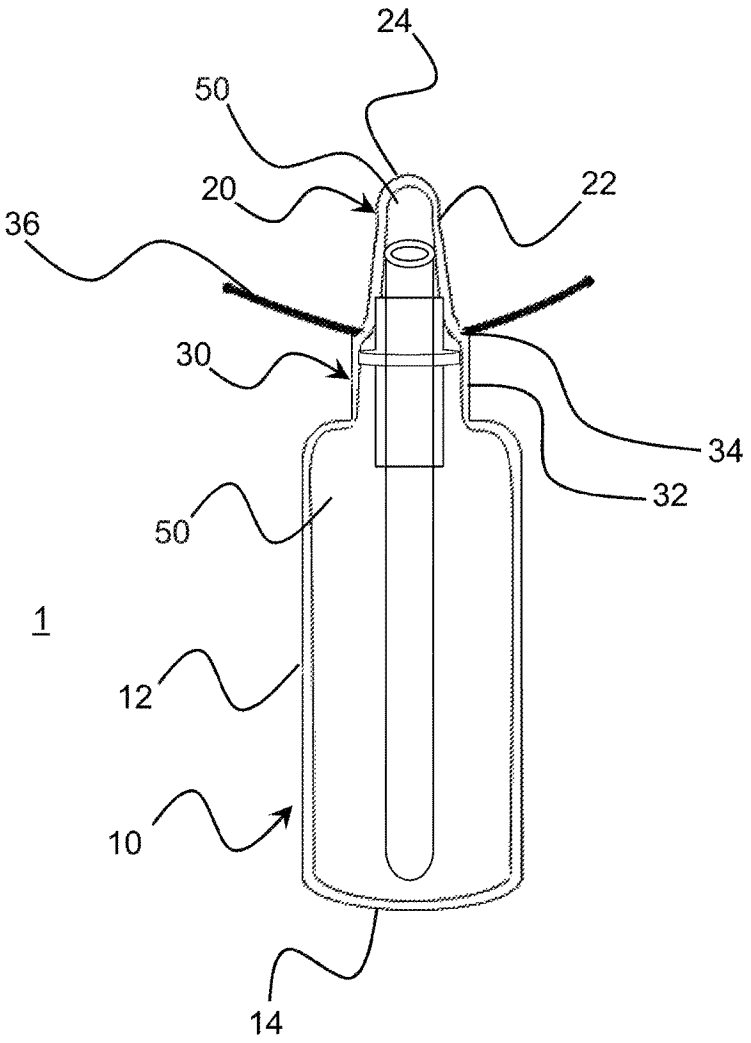
FIG. 3 is a cross section view of the assembled teether.

For safety reasons, the teether would also have a butterfly flange 36, also shown in FIG. 2A, to prevent the nipple 20 from entering too far into to mouth, thereby preventing a choking hazard.

As further shown in FIG. 2, the teether 1 includes a teething stick 40 with a tapered first end 42 and a blunt second end 44. In other embodiments, the first end 42 is also envisioned having a blunt end or a flared end. The first end 42 may also be provided with an elastic compression region to aid with reciprocal motion of the teething stick 40. The blunt second end 44 may also have a protruding circumferential ridge. The teething stick may also be provided with a stop to prevent the complete removal of the teething stick 40 from the cylindrical body 10. A stabilizer 46 may be positioned within the neck 16 of the cylindrical body 10 to provide stability for the teething stick 40 so that the teething stick will be guided along a central axis of the teether.

In operation, the teether 1 is assembled with the teething stick 40 placed within the cylindrical body 10. The cylindrical body 10 is filled with a liquid 50. The nipple 20 and cap 30 are fixed to the cylindrical body 10 with the teething stick 40 positioned for sliding engagement within the nipple 20. The tapered first end 42 of the teething stick 40 is positioned within the cylindrical body 10 and the blunt second end 44 is positioned within the nipple 20.

The assembled teether 1 is placed in a freezer. In one embodiment, the teether 1 is placed in the freezer substantially vertical. The teether 1 can be placed individually in the freezer or within a support stand placed in the freezer to assist with keeping the teether 1 substantially vertical during freezing. As the liquid 50 within the teether 1 freezes, the teething stick 40 rises within the nipple 20. With the teething stick 40 positioned within the nipple 20, the teething stick 40 provides rigidity to the nipple 20. The vertical orientation of the teether 1 causes the teething stick 40 to be pushed within the nipple 20 during freezing. When the teething stick 40 is frozen in the vertical orientation, the first end 42 of the teething stick 40 may be a blunt end.

In another embodiment, the teether 1 is frozen while the teether 1 is in any orientation other than vertical. When the teether 1 is frozen in an orientation other than vertical, the tapered first end 42 of the teething stick 40 assists with positioning the teething stick 40 within the nipple 20. As the liquid 50 freezes, the frozen material pushes against the tapered first end 42 and thus pushes the teething stick 40 into the nipple 20.

When the liquid 50 within the teether 1 is substantially frozen, the teether 1 is ready for use by a baby. The nipple 20 of the teether 1 is placed within the mouth of the baby. The baby can grasp the cylindrical body 10. For this purpose, the external surface of the cylindrical wall 12 of the cylindrical body 10 may be smooth, textured or provided with indentations forming a grip. Additionally, the external surface of the cylindrical wall 32 of the cap 30 may be smooth, textured or provided with indentations forming a grip. The liquid 50 is more generally considered a fluid. The fluid may be a mixture of partially crystallized water and non-crystallized water. The fluid may also be a gel or other various materials that exhibit fluid properties.

In some embodiments as shown in FIGS. 1-4, the cylindrical body 10 includes the neck 16. This neck 16 provides a smaller diameter section that the baby and hook one or more fingers around the neck 16 while sucking on the nipple 20. In another embodiment as shown in FIG. 5, the cylindrical wall 12 of cylindrical body 10 terminates at the externally threaded opening 18 without using the neck 16 of FIGS. 1-4.

The baby can bite down on the nipple 20. The frozen liquid 50 within the nipple 20 provides a soothing sensation to the gums of a teething baby. The teething stick 40 provides rigidity to the nipple 20 while the liquid 50 within the teether 1 is frozen. As the liquid 50 within the teether 1 melts, the teething stick 40 is moved back and forth, into and out of the cylindrical body 10 by the actions of the baby. This reciprocal motion of the teething stick 40 in the nipple 20 delivers a massaging action to the gums as the baby uses the nipple of the teether 1. When the liquid 50 within the teether 1 is completely melted, the baby can still use the teether 1 as a soother.

Figure 4:
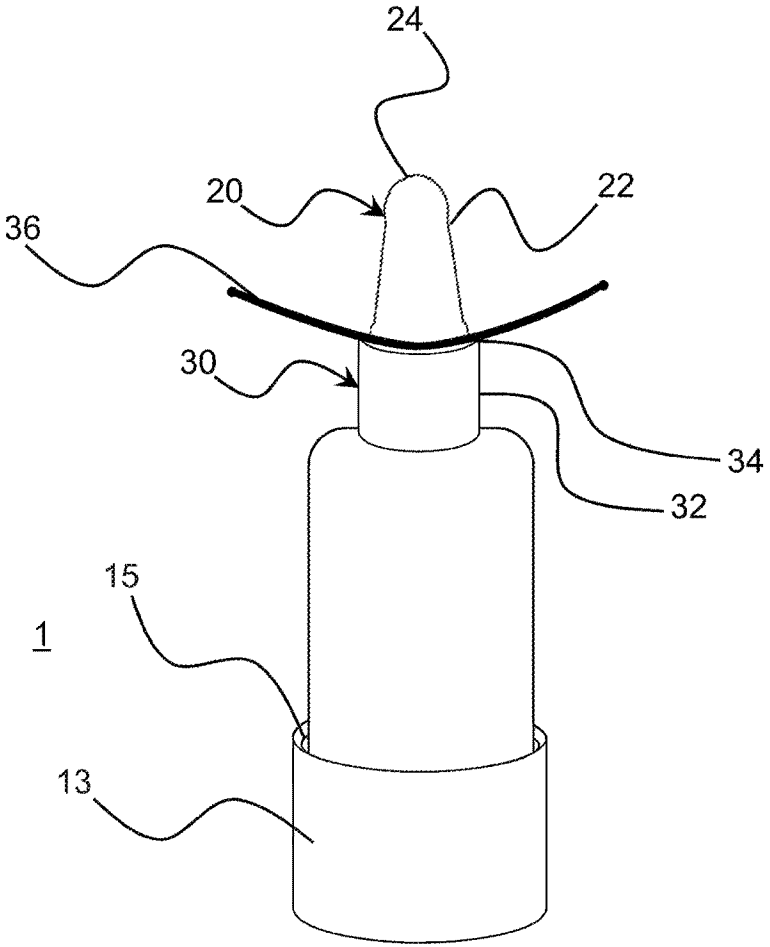
FIG. 4 is a cross section of a double wall of an alternate embodiment of the teether.
Figure 5:
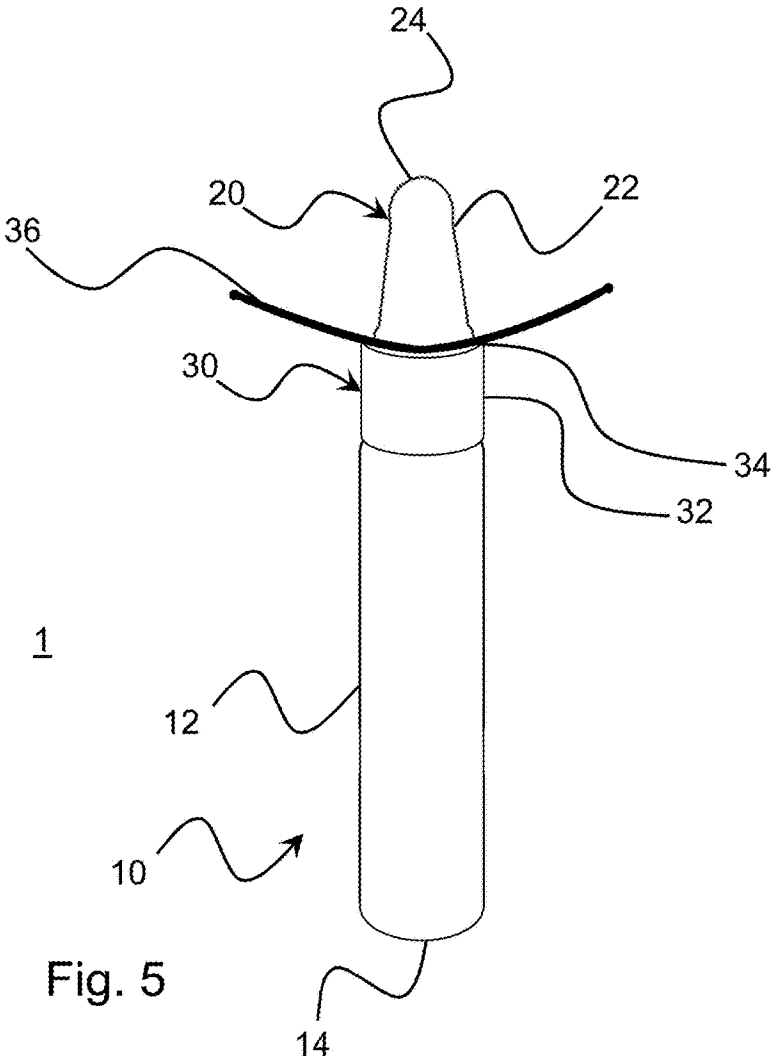
FIG. 5 is a perspective view of another alternate embodiment of the teether.

As shown in FIG. 4, additional comfort may be provided to the baby by having the cylindrical body 10 further including an insulative double-wall formed by the cylindrical wall 12 and a second outer cylindrical wall 13. An insulative means 15 such as insulation material is positioned between the cylindrical wall 12 and second outer cylindrical wall 13. The double wall of the cylindrical body 10 also keeps the liquid 50 within the teether 1 in a frozen state longer.

Figure 6:
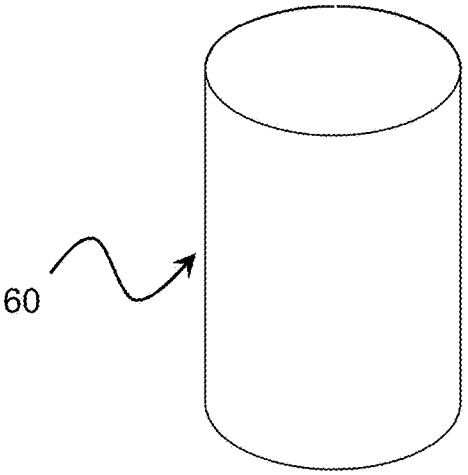
FIG. 6 is a perspective view of a teether sleeve.

FIG. 6 shows a sleeve 60 as an alternate means to insulate the frozen teether 1. The sleeve 60 may be made using neoprene or like material. In use, the frozen teether 1 is placed within the sleeve 60 thereby providing an outer most wall that has not been in a freezer and is at room temperature.

Figure 7A:
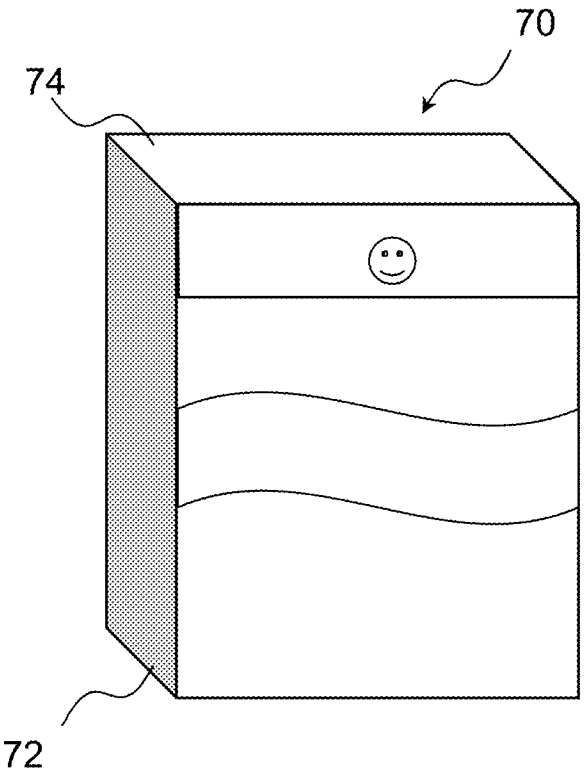
FIG. 7A is an illustrative perspective view of a storage container for the teether.
Figure 7C:
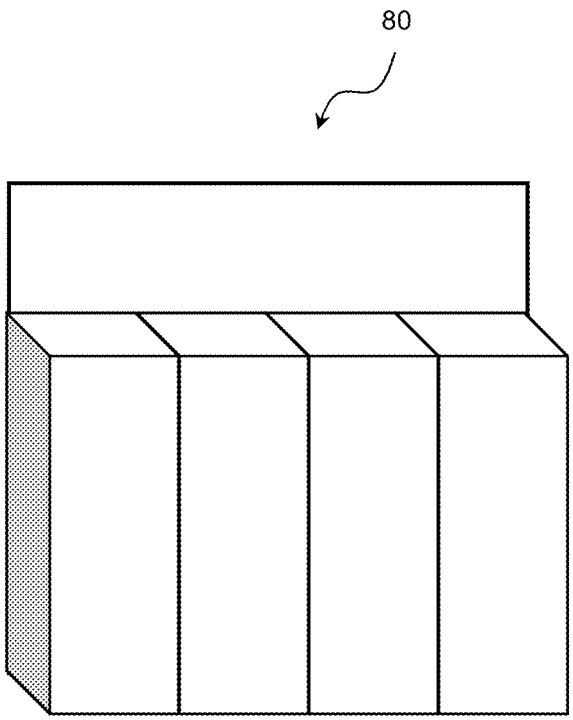
FIG. 7C is an illustrative perspective view of an storage container insert for the teether.
Figure 7B:
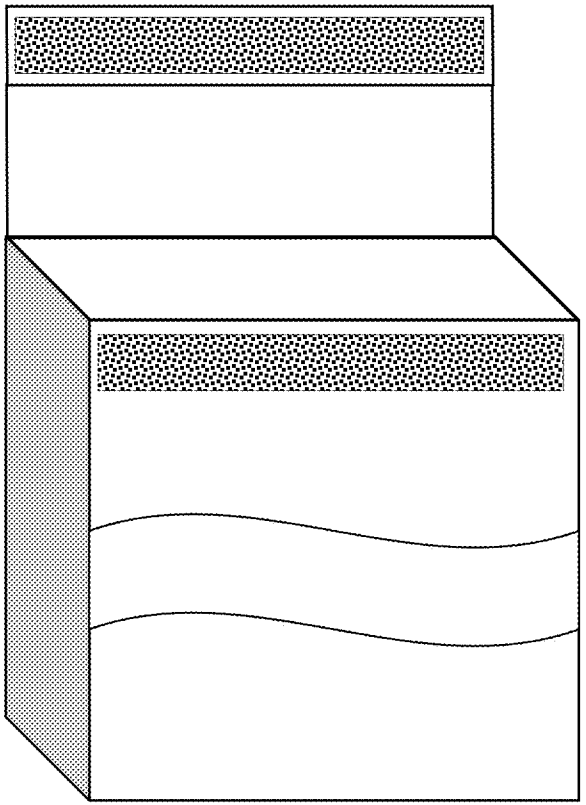
FIG. 7B is a perspective view of the open storage container for the teether.

After the liquid 50 with the teether 1 is frozen, it may be desirable to store the teether 1 in an insulated storage container 70 that is portable, as shown in FIGS. 7A-7C. The storage container 70 includes a storage compartment 72 and a lid 74. The storage compartment 72 and lid 74 are provided with a double-walled structure with an insulative means therebetween. The storage container 70 may include handles located on opposite sides of the storage compartment 72 or a shoulder strap The storage container 70 includes a stand 80 that is positioned within the storage container 70. The stand 80 is capable of maintaining multiple teethers 1 in a vertical orientation within the storage container 70. The stand 80 is removable from the storage container for freezer use.

One or more teether(s) may be stored in a portable, insulated storage container thereby keeping the pacifiers cold for several hours.

Storing pacifiers in the insulated cold storage container insures that the baby will have a continual supply of cool teething relief.

Figure 8B:
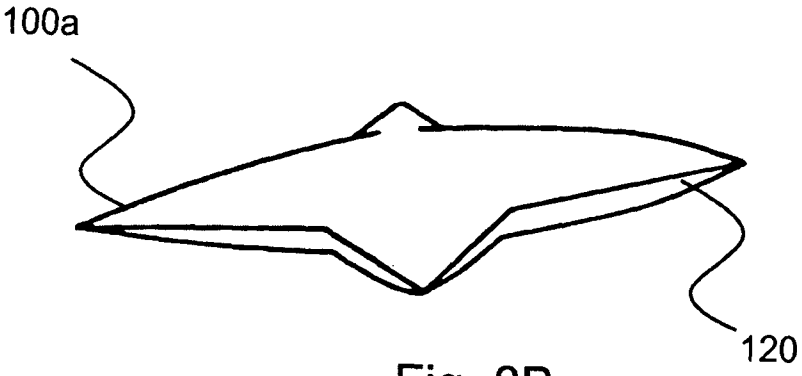
FIGS. 8A-8C are illustrative alternate embodiments of a teether.
Figure 8C:
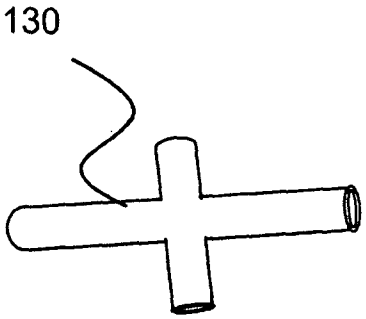
Figure 8A:
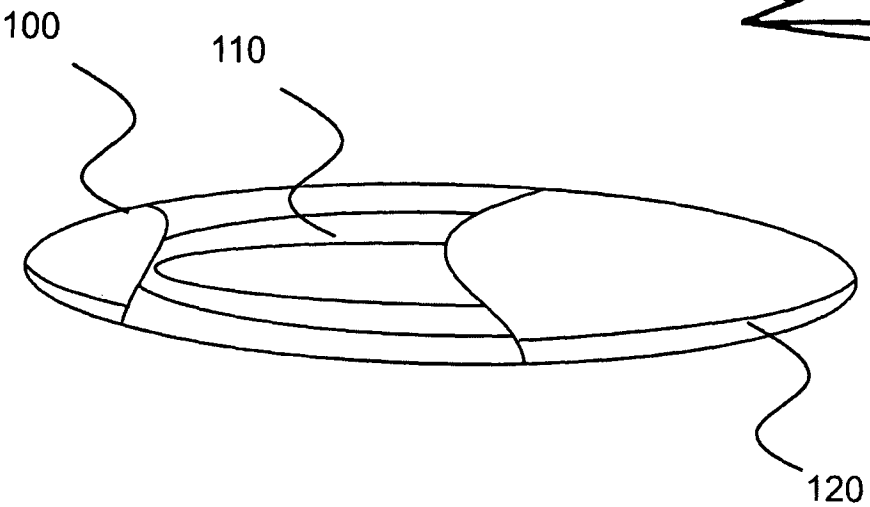

Alternative embodiments of the teether are shown in FIGS. 8A-8C. FIG. 8A shows a teether 100 with a body for containing a fluid and a central teething member. The teething member shown in FIG. 8A is a ring 110. The ring 110 is permitted to float to the acute edge 120 of the body of the teether. FIG. 8B shows a teether **100*a* with a body having four projections from the center. FIG. 8C depicts a teething member constructed with 2 crossed teething rods 130. Teething rods 130 are housed within the teether 100*a*. Alternatively, teething stick 40 previously discussed may be housed within teether 100*a***. Indeed, many other geometries of the teething member may be enclosed along with a fluid within a teething body provided that the edge of the teething body has an acute edge. This acute edge of the teething body is placed within the baby's mouth. The teething member can vacillate within the teething body and provide a massaging of the baby's gums. Other geometries of the teething body can include regular shaped geometries such as a triangle or even fun shapes such as a flattened ice cream cone.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A teether comprising:

a body containing a liquid;

a rigid teething member;

a first portion of said teether configured to reach at least half way along a gum line of a baby's mouth with a first portion of said teething member within said first portion of said teether; and a second portion of said teether configured to be prevented from entering said baby's mouth;

wherein said teething member and said liquid are positioned and sealed within said body, with said teething member being positioned within said liquid and when said liquid is a non-frozen liquid, said teething member being free to slide within said non-frozen liquid and said body;

said teething member is selected from a group consisting of a rod, a ring and crossed rods; and when said liquid is a frozen liquid, said frozen liquid provides rigidity within said body and maintains said teething member in a fixed position; when said liquid is a partially frozen liquid, said teething member slides within said body with resistance.

2. The teether as claimed in claim 1, wherein said body is cylindrical, and said teething member is said rod.

3. The teether as claimed in claim 2 further comprising:

a closed nipple; and a cap with a central opening;

wherein said nipple protrudes through said central opening of said cap and is fixed to said cylindrical body by said cap and seals said body.

4. The teether as claimed in claim 3, wherein said nipple comprises:

a flexible cylindrical wall;

a flexible closed rounded end located at a first end of said flexible cylindrical wall, and a flexible annular flange located at an opposite end of said flexible cylindrical wall.

5. The teether as claimed in claim 3, wherein said cap further comprises:

a cylindrical wall with internal threads; and an annular flange.

6. The teether as claimed in claim 5, wherein said cylindrical wall of said cap has a surface, said surface is selected from the group comprising a smooth surface, a textured surface and a surface with indentations forming a grip.

7. The teether as claimed in claim 3, wherein said teething member has a tapered first end and a blunt second end.

8. The teether as claimed in claim 7, wherein said blunt second end has a protruding circumferential ridge.

9. The teether as claimed in claim 3, wherein said teething member has a blunt first end and a blunt second end.

10. The teether as claimed in claim 9, wherein said blunt second end has a protruding circumferential ridge.

11. The teether as claimed in claim 2, wherein said body is a cylindrical body further comprising:

a first cylindrical wall, a bottom base, and a top opening opposite said bottom base.

12. The teether as claimed in claim 11, wherein said cylindrical body further comprising a neck between said first cylindrical wall and said top opening.

13. The teether as claimed in claim 11, wherein said first cylindrical wall of said cylindrical body has an external surface, said surface is selected from the group consisting of a smooth surface, a textured surface and a surface with indentations forming a grip.

14. The teether as claimed in claim 11, wherein said cylindrical body further comprising a second cylindrical wall around said first cylindrical wall.

15. The teether as claimed in claim 14, wherein said first and second cylindrical walls of said cylindrical body form a double-wall insulative body with an insulation material positioned therebetween.

16. The teether as claimed in claim 14, wherein said second cylindrical wall of said cylindrical body has a surface, said surface is selected from the group consisting of a smooth surface, a textured surface and a surface with indentations forming a grip.

17. The teether as claimed in claim 1, wherein said body is flexible and said first portion of said teether having at least one external edge formed by two sides joined at an acute angle, said portion of said teething member positioned within said acute angle.

18. A teether system including:

at least two teethers, each said teether having a body containing a liquid;

a rigid teething member;

a first portion of said teether configured to reach at least half way along a gum line of a baby's mouth with a portion of said teething member within said first portion of said teether; and a second portion of said teether configured to be prevented from entering said baby's mouth; and an insulated storage container having an internal support structure for said teethers;

wherein said teething member and said liquid are positioned and sealed within said body, with said teething member being positioned within said liquid and when said liquid is a non-frozen liquid, said teething member being free to slide within said non-frozen liquid and said body;

said teething member is selected from a group consisting of a rod, a ring and crossed rods; and when said liquid is a frozen liquid, said frozen liquid provides rigidity within said body and maintains said teething member in a fixed position; when said liquid is a partially frozen liquid, said teething member slides within said body with resistance.

* * * * *